United States Patent [19]

Gertzman

[11] Patent Number: 4,632,263

[45] Date of Patent: Dec. 30, 1986

[54] NIPPLE FOR A BABY WHO HAS A CLEFT IN ITS HARD PALATE

[76] Inventor: Gloria B. Gertzman, 103 Bayard St., New Brunswick, N.J. 08901

[21] Appl. No.: 696,505

[22] Filed: Jan. 30, 1985

[51] Int. Cl.[4] ..... A61J 11/00; A61J 11/04

[52] U.S. Cl. ..... 215/11 R; 215/11 B; 128/360

[58] Field of Search ..... 215/11 R, 11 B, 11 D, 215/11 C, 11 E, ; 128/359, 360; 433/167, 2; D24/45, 46

[56] References Cited

U.S. PATENT DOCUMENTS

| | | | |
|---|---|---|---|
| D262575 | 1/1982 | Araujo, Jr. | D24/46 |
| 1,012,980 | 12/1911 | Brophy | 215/11 R |
| 1,207,120 | 12/1916 | Younker | 215/11 R |
| 2,816,547 | 12/1957 | Adisman | 215/11 R |
| 4,105,032 | 8/1978 | Blomstedt | 128/360 |

FOREIGN PATENT DOCUMENTS

| | | | |
|---|---|---|---|
| 1385450 | 12/1964 | France | 215/11 R |

OTHER PUBLICATIONS

"Nuk Sauger Exercisers" American Journal of Orthodontics vol. 47, No. 8, Aug. 1961, folded insert after p. 22.

*Primary Examiner*—William Price
*Assistant Examiner*—Sue A. Weaver
*Attorney, Agent, or Firm*—Warrick E. Lee, Jr.

[57] ABSTRACT

A nipple for feeding a baby who has a cleft in its hard palate comprising a flexible hollow tube. There is a discharge opening at one end of the tube and means for attaching the tube to a bottle at the other end of the tube. An extension from the tube has a convex portion shaped to fit against the baby's hard palate and an arch-shaped concave channel to seal against the gums of the baby's upper jaw.

6 Claims, 9 Drawing Figures

NIPPLE FOR A BABY WHO HAS A CLEFT IN ITS HARD PALATE

The present invention provides a nipple for feeding a baby who has a cleft in its hard palate. A cleft palate is a birth defect wherein the baby has a hole in the roof of its mouth leading from the mouth to the nasal passage. When a baby with a cleft palate is fed, milk and food can enter the cleft and pass into the nasal passage causing gagging, choking, aspiration of food into the lungs, and even asphyxiation.

The cleft can occur in the soft palate, i.e. the soft rear portion of the roof of the mouth, or in the hard palate, i.e. the hard front portion of the roof of the mouth. Araujo, in U.S. Pat. No. Des. 262,575 discloses a nipple designed to seal a cleft in the soft palate. However, Araujo's device would not be helpful for sealing a cleft in the hard palate. Furthermore, it is believed that the device of Araujo would not attain the efficient sealing attained by the present invention.

The present invention provides a nipple for feeding a baby with a cleft in its hard palate having excellent sealing ability, thereby making it much more likely that milk and other liquids will be excluded from the cleft.

SUMMARY OF THE INVENTION

The present invention comprises a nipple for feeding a baby who has a cleft in its hard palate comprising:

(a) a flexible hollow tube having first and second ends, (b) a discharge opening at said first end, (c) means for attaching said second end to a bottle such that the hollow portion of said tube is in fluid communication with the interior of the bottle, and (d) an extension from said tube comprising:

(1) a convex section shaped to fit against the baby's hard palate, at least a portion of said convex section being located between said discharge opening and said attachment means, said convex section being attached to said tube along the entire portion of the convex section located between the discharge opening and the attachment means, and (2) a parabolic concave channel adapted to cover both the inner and outer surfaces of the front and lateral gums of the baby's upper jaw, the apex of said parabolic channel being located between said attachment means and said convex section.

A second aspect of the invention comprises a series of nipples as described above adapted to accommodate the growing mouth of a baby having a cleft palate, said series comprising at least four nipples having gradually increasing size, the extension of the smallest nipple in said series measuring about 2½ cm laterally and about 3 cm longitudinally.

A third aspect of the invention comprises a device for sealing a cleft in the hard palate during breast feeding. This device is the above-described extension.

DETAILED DESCRIPTION OF THE INVENTION

Figure 1:
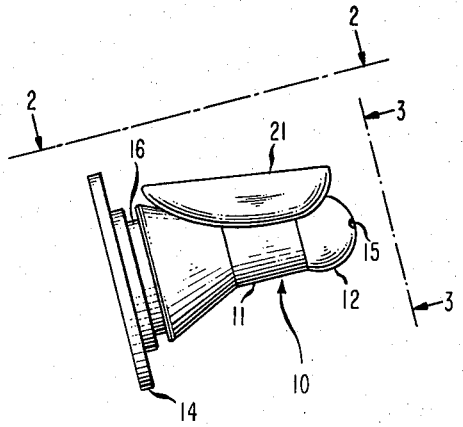
FIG. 1 is a side view of a nipple in accordance with the invention.

As illustrated in the figures, the inventive nipple 10 has a flexible hollow tube 11 typically made of soft rubber as is customary for baby-bottle nipples. Tube 11 preferably has a cone-like shape with somewhat concave sides, as shown, which is also customary. Tube 11 has a first end 12 and a second end 14. A discharge opening 15 is located at first end 12. Second end 14 has means 16 for attaching the nipple to a bottle, (see FIG. 5) such that hollow portion 17 (see FIG. 4) of tube 11 is in fluid communication with the interior 18A of the bottle.

Figure 5:
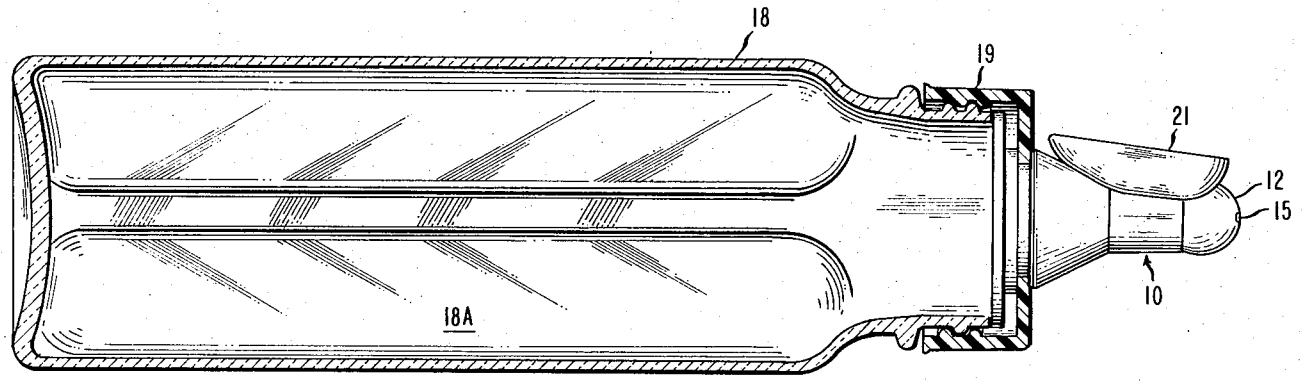
FIG. 5 is a longitudinal sectional view of the inventive nipple attached to a bottle.

The type of attachment means is not critical and forms no part of the invention. In the figures these means are a groove 16 adapted to fit within a threaded cap 19 as shown in FIG. 5. In this case cap 19 is considered to be part of the bottle. Other means for attaching the nipple to a bottle are acceptable. For example, the second end of tube 11 could be cap-shaped or threaded to attach directly to the bottle.

Figure 4:
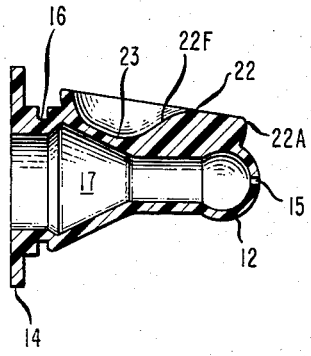
FIG. 4 is a sectional view of the nipple taken along section 4—4 of FIG. 3.

A key feature of the invention is an extension 21 from tube 11 uniquely shaped to seal a cleft in the hard palate during feeding. Extension 21 has a convex section 22 shaped as shown to fit against the baby's hard palate and the anterior portion of the soft palate when the nipple is placed in the baby's mouth with the extension 21 facing the roof of the mouth. At least a portion of convex section 22, preferably all of section 22, is located between discharge opening 15 and attachment means 16. As shown in FIG. 4, the convex section is attached to the hollow tube along the entire portion of the convex section that is located between the discharge opening and the attachment means.

Convex section 22 has an arch with its apex 22A located near first end 12. The arch curves downward toward the right 22R, left 22L, and front 22F of convex section 22. In this case the terms "left", "right", "front", and "down" are used with respect to a baby into whose mouth the nipple has been placed.

Figure 3:
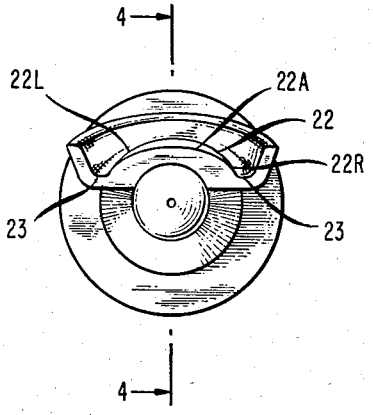
FIG. 3 is an end view of the nipple of FIG. 1 taken along line 3—3.

To provide for better sealing of the cleft, a parabolic concave channel 23, adapted to cover both the inner and outer sides of the baby's gums is provided. Concave channel 23 fits against the gums somewhat as the flange of a complete upper denture would. In other words, the parabolic concave channel seals both the inner and outer surfaces of the front and lateral gums of the baby's upper jaw. The apex 23' of chanel 23 is located between attachment means 16 and convex section 22. Concave channel 23 and convex section 22 are joned to form a smooth curve as seen in FIGS. 3 and 4.

Figure 6:
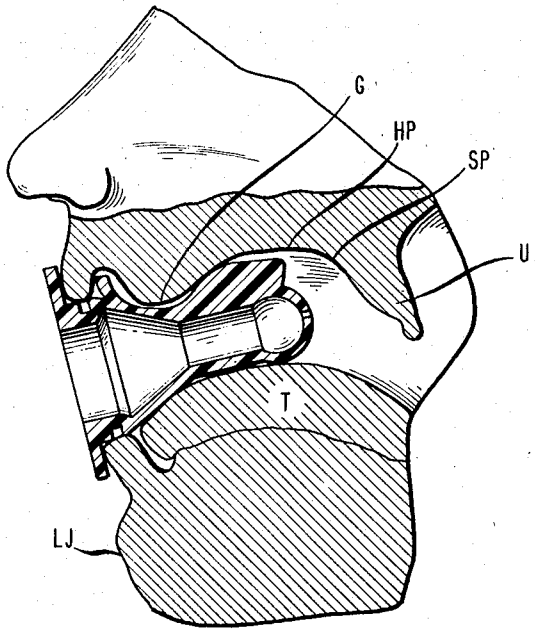
FIG. 6 is a sectional view similar to FIG. 4 showing the manner in which parts of the baby's anatomy contact the inventive nipple to seal the hard palate.

The inventive nipple operates as follows. A bottle is filled with milk or other feeding fluid and the nipple is attached, as shown in FIG. 5. Tube 11 and extension 21 are inserted into the baby's mouth with extension 21 facing the roof of the mouth. FIG. 6 illustrates the manner in which the inventive nipple engages various parts of the baby's mouth. When the baby begins to suck on tube 11, pressure from the lower jaw LJ and tongue T pushes extension 21 upward so that convex section 22 seals against the hard palate HP and the anterior or forwardmost portion of the soft palate SP. Likewise concave channel 23 fits against the gums G of the upper jaw, somewhat like a complete upper denture. As a result a seal is formed over the entire hard palate HP, the forwardmost portion of the soft palate SP, and the upper gums G, thereby making it highly unlikely that feeding fluid will enter any cleft in the baby's hard palate. Other parts of the baby's mouth not contacted by the inventive nipple are the rear portion of the soft palate, and the uvula U.

After the baby has finished feeding, the nipple is withdrawn from the baby's mouth and the bottle and nipple are cleaned and sterilized.

For best results tube 11 and extension 21 are integral with each other, molded of a single piece of flexible material. The flexible material, for example the soft rubber commonly used for conventional baby-bottle nipples, forms an excellent seal against the palate and upper gums. The material should be flexible enough to mold to the area of the cleft, yet firm enough to maintain a good seal. Flexibility also makes it easier to insert and withdraw the nipple from the mouth.

If extension 21 is flexible, its size is not extremely critical, since its flexibility will provide good sealing even if extension 21 does not exactly match the gums and hard palate. However it is desirable to provide progressively larger extensions for a better fit and to prevent restriction of growth of the palate as the size of the baby's mouth increases. Hence another aspect of the invention is a series of inventive nipples having gradually increasing size.

Figure 2:
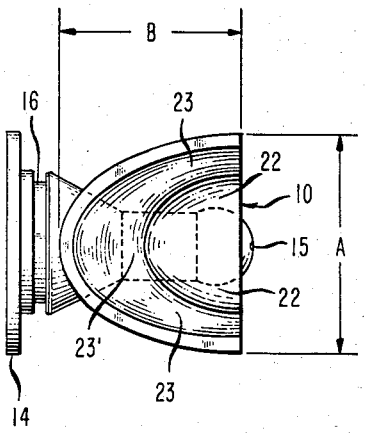
FIG. 2 is a top view of the nipple of FIG. 1 taken along line 2—2.

For a new born baby the overall lateral dimension A of the extension (FIG. 2) measured from the outer sides of convex channel 23 should be about 2½ cm; and the overall longitudinal dimension B (FIG. 2) measured from the outside of the apex of convex channel 23 to the rear of projection 21 should be about 3 cm. For older babies lateral dimension A should be about 5 cm, and longitudinal dimension B should be about 4½ cm. The series of nipples should comprise at least four nipples in gradually increasing sizes, with the smallest nipple having dimension A of about 2½ cm and dimension B of about 3 cm, and the largest nipple having A about 5 cm and B about 4½ cm.

When the baby's teeth begin to erupt, the flexibility of extension 21 will still allow it to provide a good seal of the cleft. Furthermore, the baby's teeth will fit into the bottom of concave channel 23 and, thereby avoid interfering with the seal.

Figure 8:
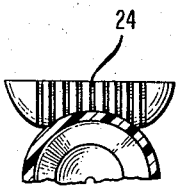
FIG. 8 is a view of the nipple of FIG. 7 taken along line 8—8.
Figure 7:
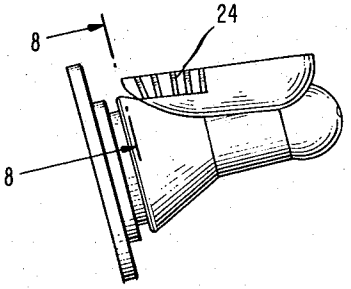
FIG. 7 is a view similar to FIG. 1 showing indicia on the outside of the nipple.

As the baby's teeth reach full size, the baby's parents or dentist can cut away a portion of convex channel 23 corresponding to the location of the teeth. Indicia 24 may be provided on the forward outside surface of channel 23 as shown in FIGS. 7 and 8. such indicia are preferably perforations in the outside surface of channel 23 that allow easy removal of parts of the channel that may interfere with fully grown teeth.

Figure 9:
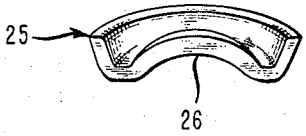
FIG. 9 is a view similar to FIG. 3 of a device for sealing a cleft in the hard palate during breast feeding.

If the baby is to be breast fed, the device illustrated in FIG. 9 may be used. This device is the same as extension 21 of the nipple shown in FIGS. 1, 2, 3, and 4, except that in this case there is no nipple, only the extension by itself. The device of FIG. 9 has a concave portion 26 on its bottom, instead of a nipple.

What is claimed is:

1. A nipple for feeding a baby who has a cleft in its hard palate comprising:

(a) a flexible hollow tube having first and second ends, (b) a discharge opening at said first end, (c) means for attaching said second end to a bottle such that the hollow portion of said tube is in fluid communication with the interior of the bottle, and (d) an extension from said tube comprising:

(1) a convex section shaped to fit against the baby's hard palate and a portion of the soft palate, at least a portion of said convex section being located between said discharge opening and said attachment means, said convex section being attached to said tube along the entire portion of the convex section located between the discharge opening and the attachment means, and (2) a parabolic concave channel adapted to cover both the inner and outer surfaces of the front and lateral gums of the baby's upper jaw, the apex of said parabolic channel being located between said attachment means and said convex section.

2. The nipple of claim 1 wherein said tube and extension are integral with each other molded of a single piece of flexible material and wherein all of said convex section is located between said discharge opening and said attachment means.

3. A series of nipples in accordance with claim 2 adapted to accomodate the growing mouth of a baby, said series comprising at least four nipples having extensions of gradually increasing size.

4. The series of claim 3 wherein the overall dimension of the smallest and largest extensions are as follows:

| | smallest | largest |
|---|---|---|
| lateral dimension | 2½ cm | 5 cm |
| longitudinal dimension | 3 cm | 4½ cm. |

5. The nipple of claim 2 having indicia on said concave channel corresponding to the locations at which the baby's teeth are expected to grow.

6. The nipple of claim 5 wherein said indicia are perforations in the outside surface of said concave channel.

* * * * *